United States Patent [19]

Dönmez et al.

[11] 4,305,246

[45] Dec. 15, 1981

[54] RING RAIL WITH AIR-SUSPENDED SPINNING OR TWISTING RINGS

[75] Inventors: Atilla Dönmez; Wolfgang Igel, both of Ebersbach, Fed. Rep. of Germany

[73] Assignee: Firma Zinser Textilmaschinen GmbH, Ebersbach, Fed. Rep. of Germany

[21] Appl. No.: 145,195

[22] Filed: Apr. 29, 1980

[30] Foreign Application Priority Data

May 3, 1979 [DE] Fed. Rep. of Germany ..... 2917857

[51] Int. Cl.[3] ..... D01H 7/56; D01H 7/64

[52] U.S. Cl. ..... 57/124

[58] Field of Search ..... 57/122, 124

[56] References Cited

U.S. PATENT DOCUMENTS

| | | | |
|---|---|---|---|
| 3,481,131 | 12/1969 | Chilpan | 57/124 |
| 4,030,282 | 6/1977 | Spies | 57/124 |
| 4,051,65 7 | 10/1977 | Spies | 57/124 |
| 4,095,402 | 6/1978 | Yamaguchi | 57/124 |

*Primary Examiner*—Donald Watkins

*Attorney, Agent, or Firm*—Edwin E. Greigg

[57] ABSTRACT

A new ring rail having air-suspended spinning or twisting rings suspended in air bearings is proposed, the improvement residing in that an intermediate ring is releasably connected to a bearing stator in an outer ring and thus can be quickly exchanged at any time.

9 Claims, 1 Drawing Figure

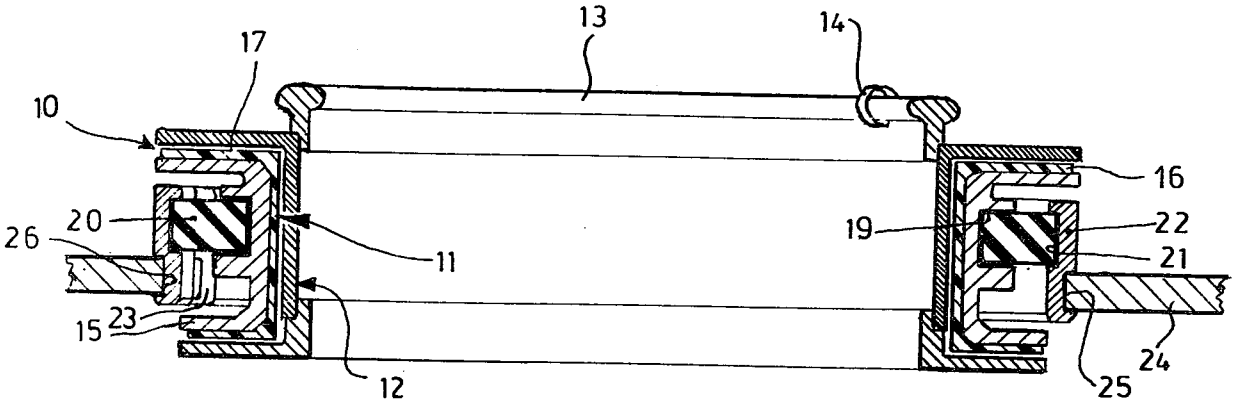
10
17
13
14
16
22
21
24
25
19
11
12
20
26
23
15

RING RAIL WITH AIR-SUSPENDED SPINNING OR TWISTING RINGS

BACKGROUND OF THE INVENTION

The invention relates to a ring rail having spinning or twisting rings air-suspended in air bearings.

Ring rails of this kind are part of ring spinning or ring twisting machines. Each spinning or twisting ring has a textile spindle passing through it in a known manner, carrying a sheath or spool on which the thread or yarn produced at the particular spinning or twisting location is wound, this thread or yarn passing through a rotor disposed on the spinning or twisting ring and as a result the rotating spindle causes the rotor and thus the spinning or twisting ring to rotate. The air suspension of the rotor of the spinning or twisting ring may be static or dynamic. In the case of static air suspension, compressed air is blown in between the bearing stator and the rotor, while in contrast in the case of dynamic air suspension, the rotor creates the air cushion effecting the air suspension as a result of its rotation. The invention relates to both kinds of air suspension.

In a known ring rail of the type described above, an intermediate ring made of foam material is secured on the bearing stator of the air bearing, and is attached directly on the ring rail (see German laid-open application No. 2,346,575). This makes it necessary to glue the intermediate ring to the ring rail, which takes time. Also, in the event that it becomes necessary to exchange this intermediate ring or the air bearing for a new intermediate ring or a new air bearing, this exchange again takes time and is accordingly expensive. There is also the danger that because of the gluing of the intermediate ring to the ring rail, non-uniform tensions may arise over the circumference of this intermediate ring, which tend to move the air bearing out of center and/or move it obliquely relative to the upper ring rail plane.

OBJECTS AND SUMMARY OF THE INVENTION

It is accordingly a principal object of the invention to enable rapid and precise mounting of the bearing stator of the air bearing on the ring rail.

This object is attained by means of the invention disclosed in claim 1.

Because the intermediate ring or rings are entirely or substantially surrounded by an outer ring which holds them and which is disposed on the ring rail in a releasable manner, the exact mounting of the bearing stator on the ring rail can be undertaken quickly and without difficulty, and the exchange of the bearing stator and/or of the intermediate ring can be performed quickly and without difficulty.

Advantageous further embodiments of the invention are described in the dependent claims.

Because in accordance with claim 2 the intermediate ring is releasably connected to the bearing stator in the outer ring, that is, it is connected in a form-fitting and/or force-locking manner, this intermediate ring can be separately exchanged at any time, quickly and without difficulty, in the spinning or twisting machine in which it is used. This may occur, for instance, when the material of which the intermediate ring is made have become fatigued or if an intermediate ring of different elasticity is desired or necessary. It is preferably provided that the intermediate ring is connected with the bearing stator in the outer ring in a form-fitting manner with pre-stressing. To this end, it may particularly advantageously be provided that the intermediate ring, preferably in one piece, is inserted into an outer groove of the bearing stator and an inner groove of the outer ring, with pre-stressing, in a form-fitting and releasable manner.

Although a releasable, form-fitting and/or force-locking connection of the intermediate ring with the bearing stator in the outer ring is preferably provided, a non-releasable connection of the intermediate ring with the bearing stator and/or the outer ring also can be provided in many cases, because this may be done economically and precisely in the factory which produces the air bearing, that is, outside the spinning or twisting factory, as a result of the releasable connection which is possible between the outer ring and the ring rail. In that case, however, the intermediate ring is no longer separately interchangeable by itself.

In a preferred further embodiment, it is provided that the outer ring is releasably inserted into an aperture in the ring rail. It can be held releasably on the ring rail, in that event, by means of an expansion ring, for instance, placed upon it below the ring rail. In many cases, it is also conceivable and it may be efficient merely to place the outer ring on the ring rail and to connect it to the ring rail releasably, for instance by means of screws, because tensions in the outer ring which may be caused in this case do not have a deleterious effect on the elastic suspension of the bearing stator, because of the elastomeric intermediate ring.

In claim 4, a very particularly advantageous manner of attaching the outer ring to the ring rail is described, which distinguishes itself, among other factors, by structural simplicity and by the elimination of specialized connection elements between the outer ring and the ring rail and also enables the most rapid possible attachment of the outer ring to the ring rail and removal therefrom.

Reference is further made to the fact that it is efficient for the air bearing system having a spinning or twisting ring, supported elastically by means of the intermediate ring or rings, to have a natural vibration frequency which is lower than the operating rpm of the spinning or twisting ring.

The outer ring is made up of incompressible material, that is, material which can be considered as practically incompressible under the stresses which appear in the present application. Preferably, this material may be metal, and in particular steel. Other materials may also be possible in certain cases, such as very hard durable plastics.

The intermediate ring may preferably be embodied as closed in itself and rotationally symmetrical and may be made of some suitable elastomeric material, preferably rubber or elastomeric plastic. Its hardness may be preferably in the range from 35 to 50 Shore.

The invention will be better understood, and further objects and advantages thereof will become more apparent from the ensuing detailed description of a preferred embodiment taken in conjunction with the drawing.

BRIEF DESCRIPTION OF THE DRAWING

The single FIGURE of the drawing is a cross sectional view taken through a ring rail of a ring spinning or twisting machine, not shown in further detail, having a spinning or twisting ring which is air-suspended by means of a dynamic air bearing, wherein a multiplicity of such air-suspended spinning or twisting rings are disposed on the ring rail, in a manner not shown, in a row extending perpendicular to the plane of the drawing.

The foregoing relates to preferred exemplary embodiments of the invention, it being understood that other embodiments and variants thereof are possible within the spirit and scope of the invention, the latter being defined by the appended claims.

DESCRIPTION OF THE PREFERRED EMBODIMENT

Turning now to the drawing, the dynamic air bearing 10, seen in cross section in this drawing, comprises a bearing stator 11 and a rotor 12 disposed coaxially therewith. The spinning or twisting ring 13 is fixedly disposed on the rotor 12. In a known manner, a runner 14 is disposed on the T-flange of the spinning or twisting ring 13. The runner 14 may revolve on the T-flange and during operation is dragged along by the thread or yarn to be twisted or rotated thereby, as a result of which the ring 13 is also driven rotationally. The bearing stator 11 has a metallic profile ring 15, upon which, as shown, a plastic coating 16 is applied thereby forming bearing surfaces. In a manner not shown, but known, spiral, flat channels are provided in the upper horizontal bearing faces 17 of the rotor 12, as a result of which the rotation of the rotor 12 creates a pressure cushion made up of air. *This cushion supports the rotor* 12 *and thus also the spinning or twisting ring* 13. A single intermediate ring 20 of elastomeric material, preferably rubber, is inserted into a circumferential, annular outer groove 19 of the bearing stator 11, which is rotationally symmetrical and coaxial with the rotational axis of the rotor 12, in a form-fitting manner with pre-stressing. The intermediate ring 20 has a rectangular profile and is rotationally symmetrical, and with its outer circumference it is inserted into an annular inner groove 21 of an outer ring 22, made of flexible metal, in a form-fitting manner with pre-stressing. This outer ring 22, in this preferred exemplary embodiment, is not completely closed; instead, it has a narrow slit 23 interrupting it at one single point, serving to assure that this outer ring 22 can be flexibly compressed to such an extent that it can be inserted into a ring rail 24 in the illustrated position or can be readily removed from this ring rail.

This outer ring 22 has an outer circumferential groove 25, which is coaxial with the rotational axis of the rotor 12, and into which the rim region of a circular cylindrical aperture 26 of the ring rail 24 protrudes engagingly in a form-fitting manner. Also, the outer ring 22 is pressed with pre-stressing against the rim of the aperture 26, so that it is connected to the ring rail 24 without play and, at the forces appearing during operation at the ring rail 24, the outer ring 22 also does not rotate.

The elastomeric intermediate ring 20 produces an elastic support of the system comprising the air bearing 10 and the spinning or twisting ring 13, so that this system 10, 13 can absorb rotary imbalances, which may be brought about by the runner 14, for instance, without overloading the air bearing 10.

In some cases it may also be provided that in place of the single, one-piece, closed intermediate ring 20, two or more intermediate rings, either separate or connected to one another, are inserted into the grooves 19, 21, preferably disposed such that they rest one above the other, and/or that the intermediate ring is formed by bending a straight strip, and so forth.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A ring rail with air-suspended spinning or twisting rings, wherein each said spinning or twisting ring is fixedly disposed on a rotor of an air bearing, said bearing being suspended by air in a bearing stator, said stator being held elastically and limitedly movable on said ring rail by means of at least one elastomeric intermediate ring arranged coaxially with the said bearing stator characterized in that said intermediate ring which surrounds said bearing stator is held in an outer ring of incompressible material, and is releasably disposed on said ring rail.

2. A ring rail as defined by claim 1, characterized in that said intermediate ring is releasably connected to said bearing stator and said outer ring.

3. A ring rail as defined by claim 1, characterized in that said outer ring is releasably inserted into an aperture of said ring rail.

4. A ring rail as defined by claim 3, characterized in that said outer ring has an outer circumferential groove arranged to be received by said ring rail, said outer ring further being made of flexible slitted elastic material to permit reduction of the diameter thereof and insertion into said ring rail.

5. A ring rail as defined by claim 1, characterized in that said intermediate ring is pre-stressed and inserted into means defining an opening between said bearing stator and said outer ring.

6. A ring rail as defined by claim 1, characterized in that said outer ring is made of metal.

7. A ring rail as defined by claim 1, characterized in that said intermediate ring is made of rubber.

8. A ring rail as defined by claim 1, characterized in that a single intermediate ring is provided per said air bearing.

9. A ring rail as defined by claim 1, characterized in that said intermediate ring is rotationally symmetrical.

* * * * *